US006631900B2

(12) United States Patent
Salgado

(10) Patent No.: US 6,631,900 B2
(45) Date of Patent: Oct. 14, 2003

(54) PAPER SHEET ROTATOR (AND COMBINATION INVERTER) DEVICE FOR AN IOT

(75) Inventor: David L. Salgado, Victor, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 10/042,339

(22) Filed: Jan. 11, 2002

(65) Prior Publication Data

US 2003/0132571 A1 Jul. 17, 2003

(51) Int. Cl.[7] ..... B65H 29/00
(52) U.S. Cl. ..... 271/186; 271/184; 271/185
(58) Field of Search ..... 271/185, 184, 271/186; 198/374, 403, 404, 411

(56) References Cited

U.S. PATENT DOCUMENTS 4,412,740 A * 11/1983 Buddendeck ..... 280/47.11
4,500,086 A 2/1985 Garavuso ..... 271/225
5,374,049 A 12/1994 Bares et al. ..... 271/186
5,415,391 A 5/1995 Wong et al. ..... 271/225
6,343,686 B1 * 2/2002 Whiting et al. ..... 198/379

* cited by examiner

*Primary Examiner*—Donald P. Walsh
*Assistant Examiner*—Kaitlin Joerger
(74) *Attorney, Agent, or Firm*—N. Henry, II

(57) ABSTRACT

An apparatus that can rotate a sheet 180° or invert the sheet, if required, includes a horizontal cylinder. The apparatus includes a horizontal cylinder. A front image output sheet wraps around the horizontal cylinder (turning counter-clockwise), entering the cylinder from the bottom. The cylinder then rotates 180° with the wrapped sheet. Continued counter-clockwise rotation of the cylinder will now unwrap the sheet from the cylinder and drive it away from the cylinder. In order to accomplish inversion, a deflector is raised in front of the cylinder. A sheet is directed over the top of the cylinder by the deflector as the cylinder turns clockwise. The sheet wraps around the cylinder and thereafter, the cylinder is rotated counter-clockwise resulting in the sheet exiting the cylinder at the bottom after having been inverted.

4 Claims, 6 Drawing Sheets

PAPER SHEET ROTATOR (AND COMBINATION INVERTER) DEVICE FOR AN IOT

BACKGROUND OF THE INVENTION

1. Field of the Invention

This invention relates to an improved sheet inverting system, and more particularly, to a compact rotator/inverter that accomplishes improved handling of variable sized sheet within minimal space requirements.

2. Description of Related Art

Although a sheet inverter is referred to in the copier/printer art as an "inverter", its function is not necessarily to immediately turn the sheet over (i.e., exchange one face for the other). Its function is to effectively reverse the sheet orientation in its direction of motion. That is, to reverse the lead edge and trail edge orientation of the sheet. Typically in inverter devices, the sheet is driven or fed by feed rollers or other suitable sheet driving mechanisms into a sheet reversing chute. By then reversing the motion of the sheet within the chute and feeding it back out from the chute, the desired reversal of the leading and trailing edges of the sheet in the sheet path is accomplished. Depending on the location is and orientation of the inverter in a particular sheet path this may, or may not, also accomplish the inversion (turning over) of the sheet. In some applications, for example, where the "inverter" is located at the corner at a 90° to 180° inherent bend in the copy sheet path, the inverter may be used to actually prevent inverting of a sheet at that point, i.e., to maintain the same side of the sheet face-up before and after this end in the sheet path. On the other hand, if the entering and departing path of the sheet, to and from the inverter, is in substantially the same plane, the sheet will be inverted by the inverter. Thus, inverters have numerous applications in the handing of either original documents or copy sheets to either maintain, or change, the sheet orientation.

Inverters are particularly useful in various systems of pre or post collation copying, for inverting the original document, or for maintaining proper collation of the sheets. The facial orientation of the copy sheet determines whether it may be stacked in forward or reversed serial order to maintain collation. Generally, the inverter is associated with a by-pass sheet path and gate so that a sheet may selectively by-pass the inverter, to provide a choice of inversion or non-inversion. However, it is particularly difficult to use inverters of this type in small copiers that take advantage of short edge paper transport to reduce costs by reducing overall machine depth.

Short edge feeding creates a problem in sheet inversion when the duplex function is added to the machine. Some standard inverter techniques result in the top of the duplex image occurring at the bottom of the simplex image.

U.S. Pat. No. 4,500,086 issued Feb. 19, 1985 to Gerald M. Garavuso, shows a rotating inverter mechanism that includes a chute positioned to deflect a sheet from a horizontal plane downward as the sheet is rotated by action of primary and secondary rollers so that rotation can be accomplished in a distance no wider than the width of the sheet.

A compact inverter is shown in U.S. Pat. No. 5,374,049 issued Dec. 20, 1994 for reversing the lead and trail edges of a sheet. The inverter includes a reversible roller of about 2 inches in diameter onto which a sheet is scrolled and subsequently unscrolled, thereby reversing the lead and trail edges of the sheet.

In U.S. Pat. No. 5,415,391 issued May 16, 1995 to Wong et al. an inverter is shown for inverting sheets using the existing paper path to invert the sheets. A sheet is inverted by being deflected into a channel formed between a turnaround roller and a baffle. The sheet is driven by the turnaround roller back into the original paper path in a direction opposite to the incoming direction of the sheet.

Even though the above-mentioned inverting systems are useful, there is still a need, in printers that include an image output terminal (IOT), to provide a number of features (e.g., head to toe marking) requiring an image be rotated 180° with the IOT trays supporting a wide range of sheet sizes including A3 and 11×17.

SUMMARY OF THE INVENTION

Accordingly, pursuant to the features of the present invention, a sheet manipulator is disclosed that answers the above-mentioned problem by providing a device that can rotate a sheet 180° or invert the sheet, if required. The sheet manipulator includes a horizontal cylinder. A front image output sheet wraps around the horizontal cylinder (turning counter-clockwise), entering the cylinder from the bottom. The cylinder then rotates 180° with the wrapped sheet. Continued counter-clockwise rotation of the cylinder will now unwrap the sheet from the cylinder and drive it away from the cylinder. In order to accomplish inversion, a deflector is raised in front of the cylinder. A sheet is directed over the top of the cylinder by the deflector as the cylinder turns clockwise. The sheet wraps around the cylinder and thereafter, the cylinder is rotated counter-clockwise resulting in the sheet exiting the cylinder at the bottom and after having been inverted. This and other features and advantages of the invention are described in or apparent from the following detailed description of the exemplary embodiments.

BRIEF DESCRIPTION OF THE DRAWINGS

The foregoing and other features of the instant invention will be apparent and easily understood from a further reading of the specification, claims and by reference to the accompanying drawings in which like reference numerals refer to like elements and wherein:

While the present invention will be described hereinafter in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

DETAILED DESCRIPTION OF THE INVENTION

The invention will now be described by reference to a preferred embodiment of the low cost sheet manipulator apparatus for a copier/printer. However, it should be understood that the sheet manipulator apparatus of the present invention could be used with any machine in which reversal or inversion of a sheet is desired.

In general, an improvement to prior sheet inverter and sheet rotator systems for machines is discloses which is cost effective and space efficient and comprises the use of a compact apparatus that uses the existing paper path to invert or rotate a sheet.

Figure 1:
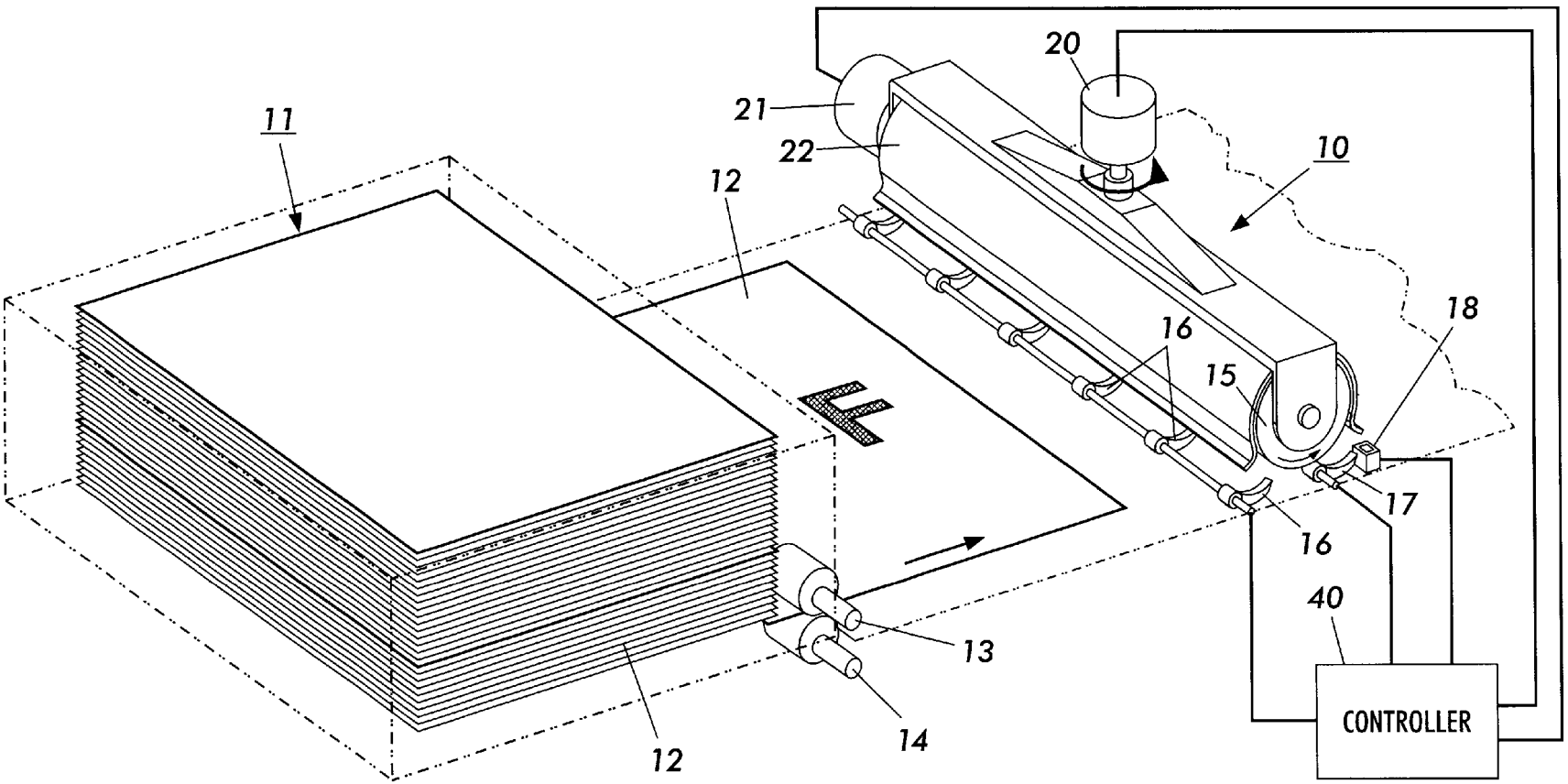
FIG. 1 is a schematic illustration of the sheet manipulator of the present invention being used as a sheet rotator.
Figure 2:
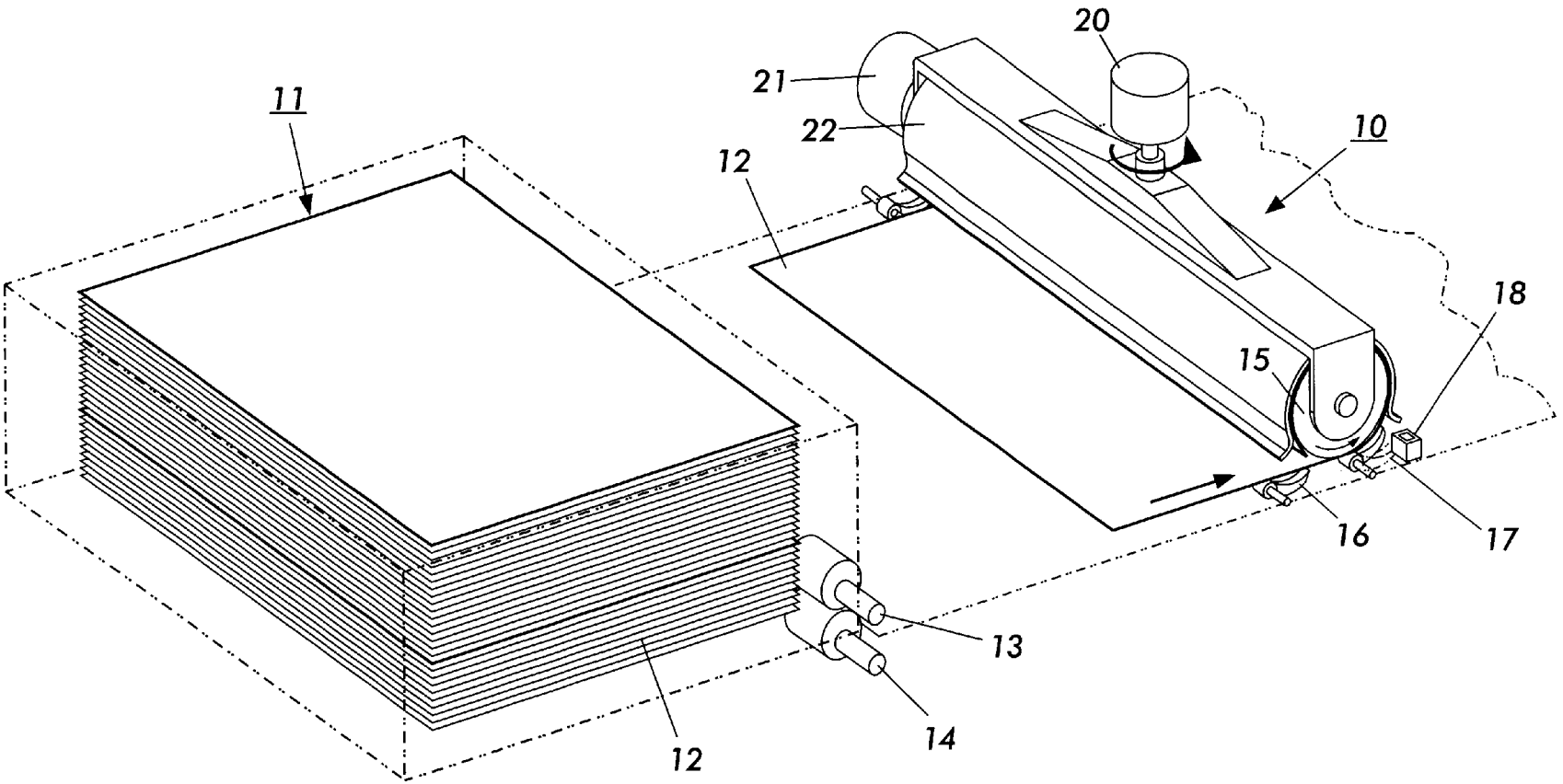
FIG. 2 is a schematic illustration of the sheet manipulator in FIG. 1 showing a sheet being wrapped around a cylinder.
Figure 3:
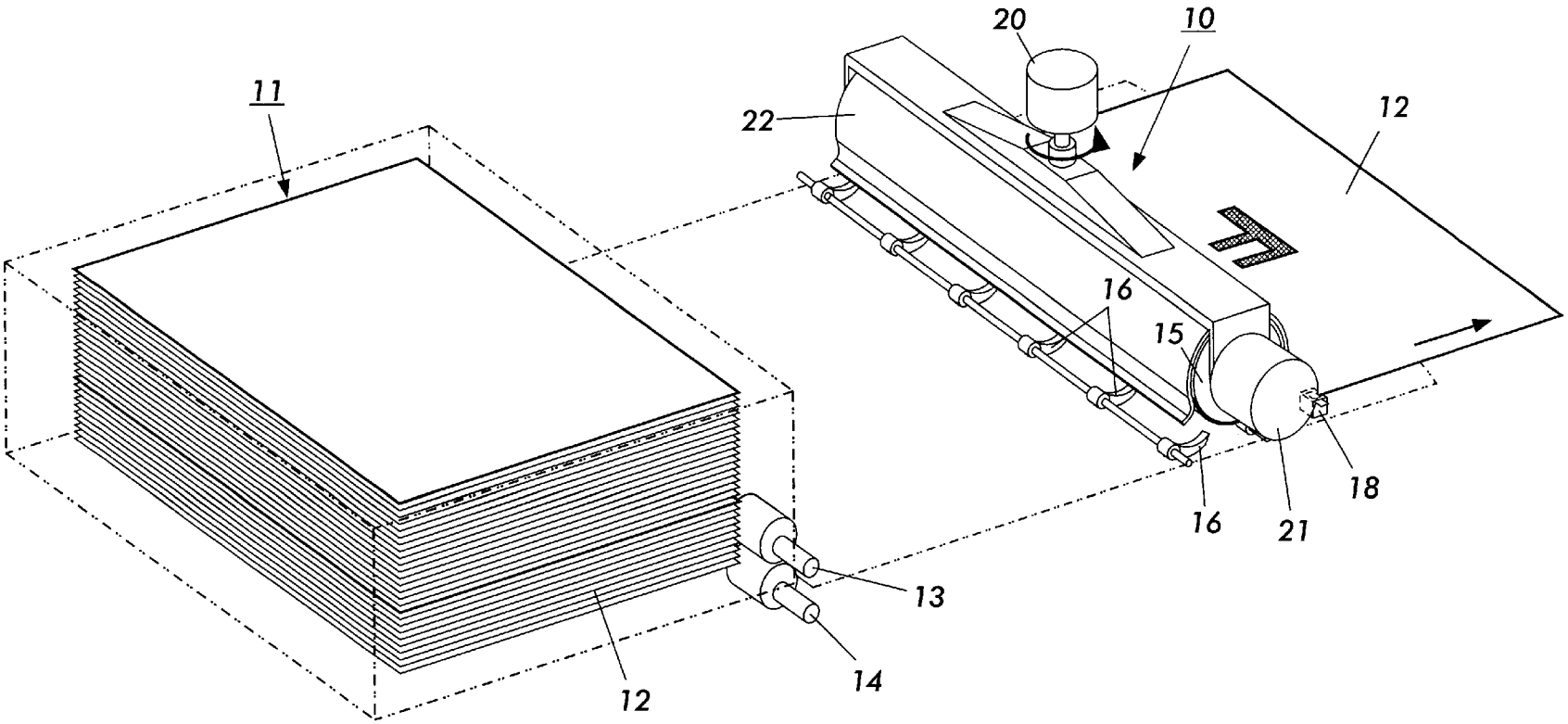
FIG. 3 is a schematic illustration of the sheet manipulator of FIG. 2 showing a sheet leaving the cylinder after it has been rotated 180°

Referring now particularly to FIG. 1, there is illustrated an exemplary sheet manipulator apparatus for use in any conventional machine that requires sheets to be rotated or inverted. The dual mode sheet manipulator apparatus 10 comprises a cylinder 15 positioned horizontally with respect to a paper path and conventionally coupled mechanically to a stepper motor 20 for rotation in a horizontal plane. When 180° rotation of sheets is required, sheet manipulator apparatus 10 is in a first mode and a sheet 12 is forwarded from, for example, a stack 11 of duplexed or one side imaged sheets 12, by conventional drive roll 13 and separating roll 14 into deflector 17 that has been actuated by controller 40 to deflect sheet 12 up and into baffle 22. Continued rotation of cylinder 15 wraps the sheet around cylinder 15 that is turning in a counter-clockwise direction. While sheet 12 is wrapped around cylinder 15 as shown in FIG. 2, Controller 40 actuates a conventional motor 20 based on the dimensions of the sheet that in turn through conventional gears and linkage rotates cylinder 15 180° in the direction of the arrow with its wrapped sheet. Continued rotation of cylinder 15 in a counter-clockwise direction drives sheet 12 away from sheet manipulator apparatus 10 for further processing in a rotated condition as shown in FIG. 3.

Figure 4:
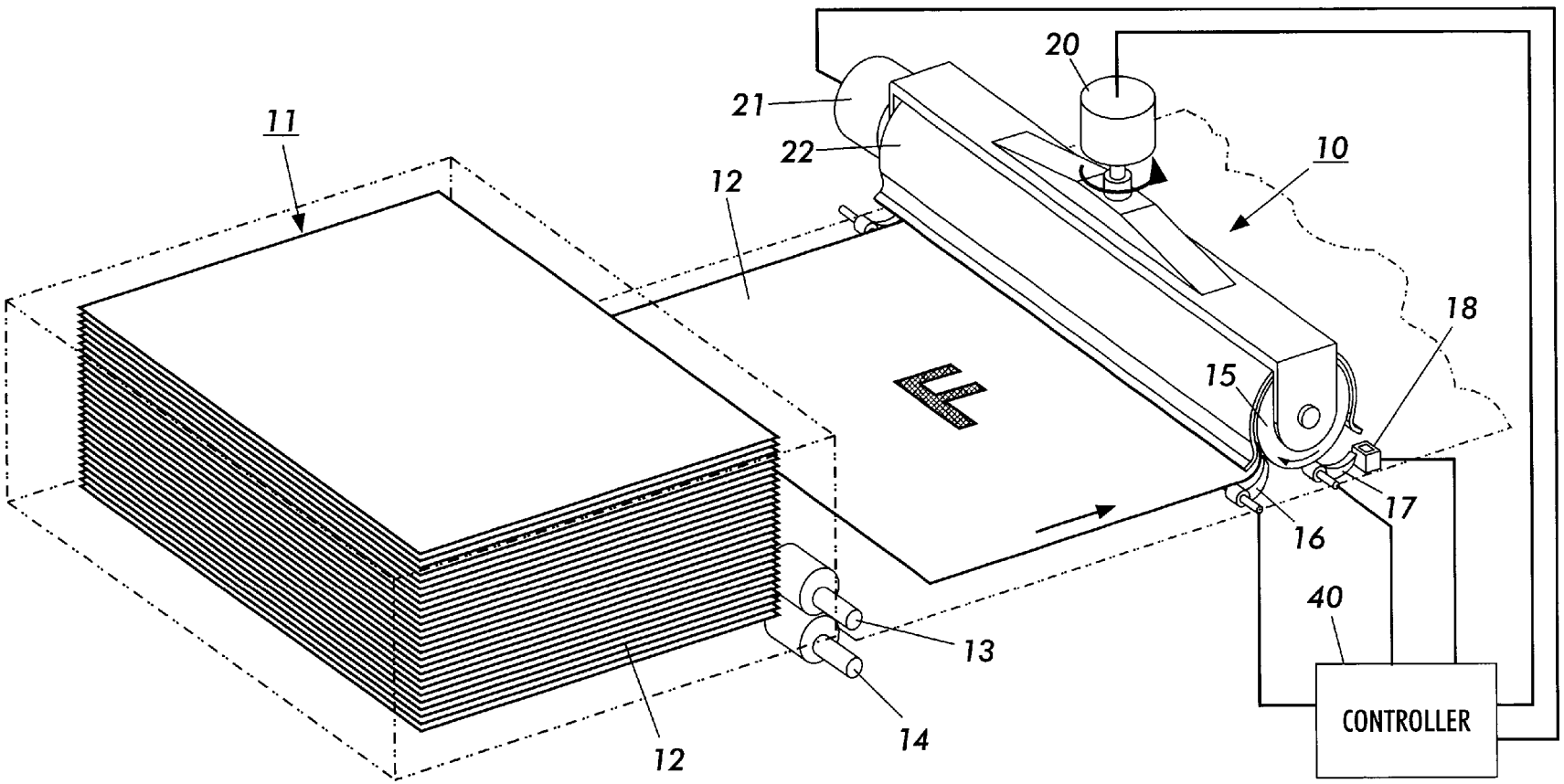
FIG. 4 is a schematic illustration of the sheet manipulator of the present invention being used as an inverter.
Figure 5:
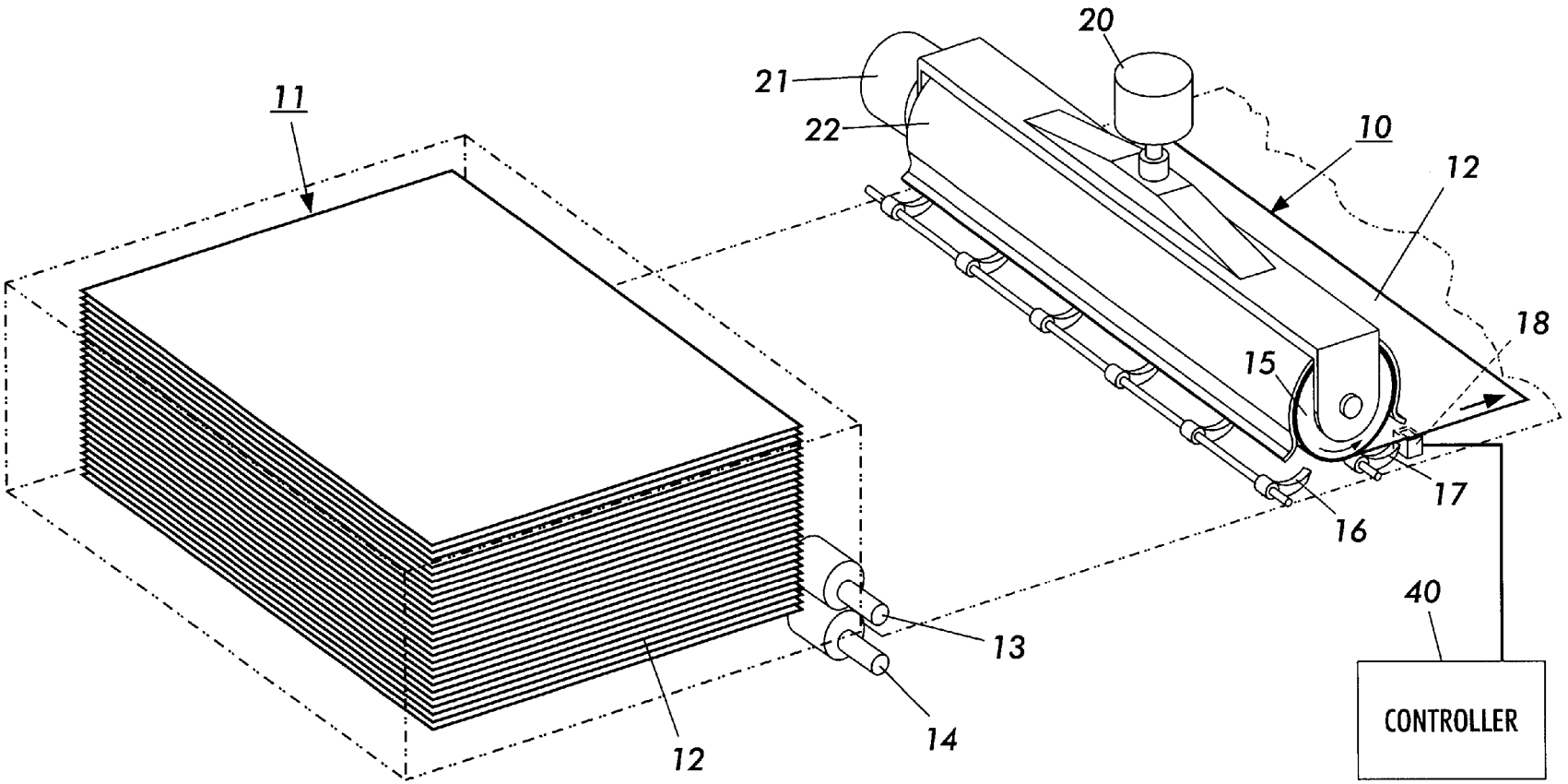
FIG. 5 is a schematic illustration of the sheet manipulator in FIG. 4 showing a sheet being wrapped around a cylinder.
Figure 6:
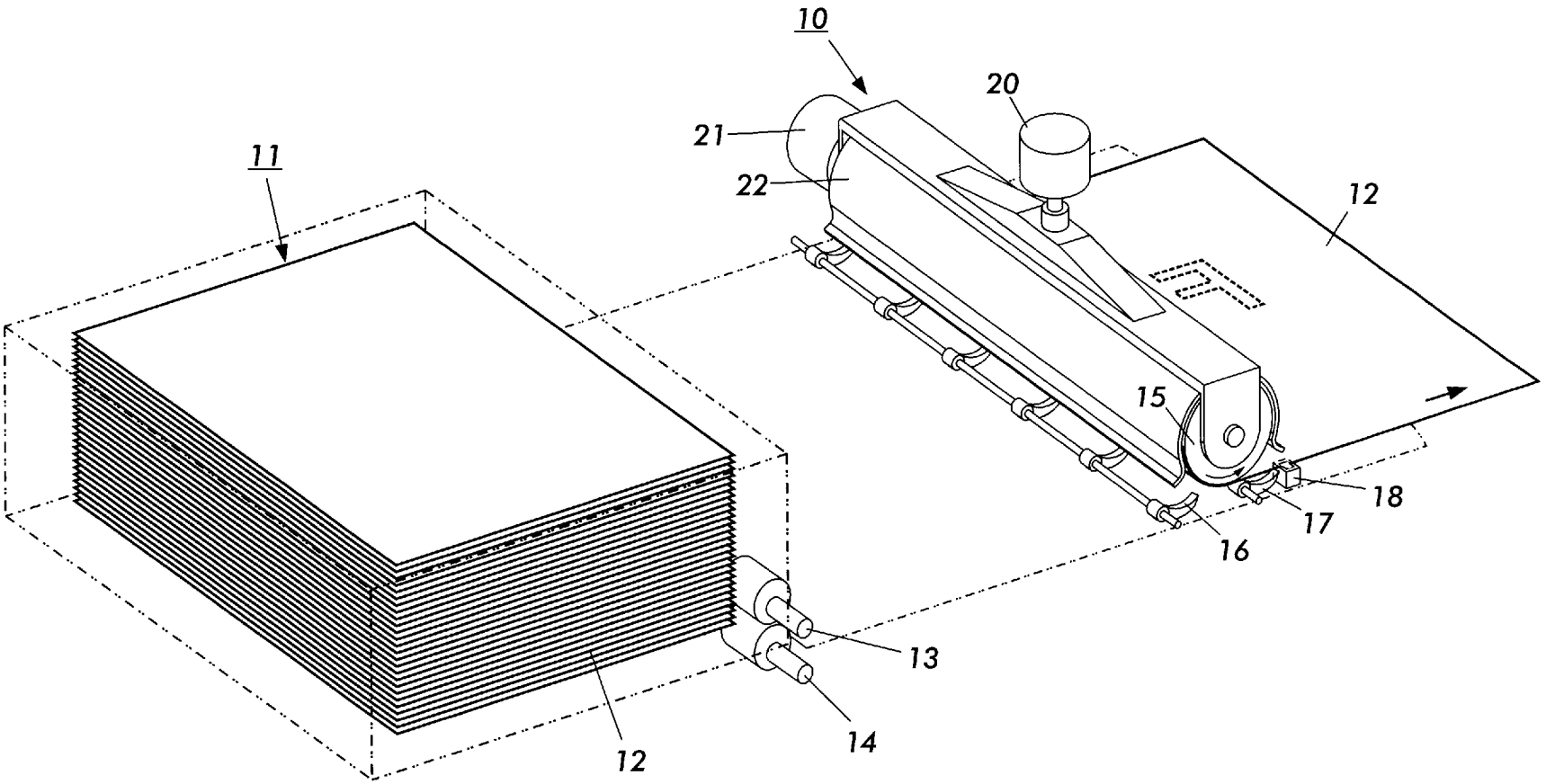
FIG. 6 is a schematic illustration of the sheet manipulator of FIG. 5 showing a sheet leaving the cylinder after it has been inverted.

When an operator selects inversion of a sheet on a machine's user interface, sheet manipulator apparatus 10 is switched by conventional controller 40 to its second mode of operation. As shown in FIGS. 4 and 5, a sheet 12 is fed from stack 11 into a now actuated deflector 16 en route to sheet manipulator 10. Deflector 16 directs sheet 12 up between baffle 22 and the front surface area of cylinder 15 and over the top of cylinder 15 that is rotating in a clockwise direction by a conventional stepper motor 21. A second deflector 17 deflects sheet 12 into wrapping engagement with cylinder 15 and the lead edge of sheet 12 contacts a rear surface of deflector 16 to ensure wrapping engagement with cylinder 15. In FIG. 6, After the trail edge of sheet 12 leaves the cylinder it covers sensor 18 which sends a signal to controller 40. Controller 40 in turn sends a signal that through stepper motor 21 reverses the rotation of cylinder 15 to a counter-clockwise direction with the now inverted sheet being unwrapped from cylinder 15 and driven away from the sheet manipulator for further processing. Alternatively, sensor 18 could be eliminated and, through software, controller 40 could be programmed to reverse rotation to a counter-clockwise direction after a predetermined time has elapsed after a sheet has been fed from sheet stack 11 in order to drive a sheet from cylinder 15.

It should now be understood that a low cost, mechanical device has been disclosed for rotating a sheet 180° or inverting a sheet of paper or other substrate in an IOT. The device consists of a horizontal cylinder connected to a motor that rotates the cylinder in a horizontal plane. An output sheet wraps around the horizontal cylinder portion of the rotating device, entering the cylinder at the bottom while the cylinder rotates in a counter-clockwise direction. The cylinder is rotated 180° to reverse the leading edge of the sheet with the cylinder continuing to rotate in a counter-clockwise rotational direction to drive the sheet away from the cylinder. To invert a sheet, the sheet is directed over the top of the cylinder which is rotating in a clockwise direction and wrapped around the cylinder. After the sheet is wrapped onto the cylinder, the cylinder reverses its direction of rotation to invert the sheet. The advantage of this device is that any size sheet can be rotated within the width of a paper path. This device enables rotating large sheets in a small space.

While the invention has been described in conjunction with the specific embodiments outlined above, it is evident that many alternatives, modifications and variations will be apparent to those skilled in the art. Accordingly, the preferred embodiments of the invention as set forth above are intended to be illustrative and not limiting. Various changes may be made without departing from the spirit and scope of the invention as defined herein.

What is claimed is:

1. A substrate manipulating apparatus adapted to rotate substrates 180°, comprising;

a cylindrical member adapted to rotate in a counter-clockwise direction;

a motor connected to said cylindrical member for pivoting said cylindrical member;

a baffle member positioned to partially surround said cylindrical member;

a deflector positioned to deflect a substrate away from a predetermined feed path after the substrate passes beneath said cylindrical member and up into a channel formed between said cylindrical member and said baffle member; and a controller adapted to actuate said motor to pivot said cylindrical member 180°, and wherein continued rotation of said cylindrical member in said counter-clockwise direction drives the substrate away from said cylindrical member.

2. A substrate inverted apparatus for inverting substrates being fed in a predetermined path, comprising:

a cylindrical member adapted to rotate in a clockwise or counter-clockwise direction;

a baffle member positioned to partially surround said cylindrical member;

a first deflector positioned upstream of said cylindrical member to deflect a substrate away from said predetermined feed path and up into a channel formed between a front portion said cylindrical member and said baffle member and over the top of said cylindrical member;

a second deflector positioned to detect the leading edge of the substrate into a path to wrap around said cylindrical member;

a controller adapted to send a signal to actuate said cylindrical member to rotate counter-clockwise and thereafter feed the inverted substrate back into said predetermined feed path.

3. The substrate inverter apparatus of claim 2, including a sensor positioned downstream of said cylindrical member and adapted to sense the trailing edge of the substrate, and wherein said controller is adapted to receive a signal from said sensor and actuate said cylindrical member to rotate counter-clockwise and thereafter feed the inverted substrate back into said predetermined feed path.

4. A dual mode sheet manipulating apparatus, comprising:

a cylindrical member, and wherein said cylindrical member is adapted to rotate in a counter-clockwise direction when said sheet manipulator is in a first of said dual modes and adapted to rotate in both clockwise and counter-clockwise directions when said sheet manipulator is in said second mode;

a baffle member positioned to partially surround said cylindrical member;

a first deflector positioned when said sheet manipulator is in a first mode to deflect a sheet away from a predetermined feed path after the sheet exits from beneath said cylindrical member and up into a channel formed between said cylindrical member and said baffle member in order to wrap the sheet around said cylindrical member;

a second deflector positioned to deflect the leading edge of a sheet into a path to wrap around said cylindrical member rotating in a clockwise direction when said sheet manipulator is in a second mode;

a sensor adapted to sense the trailing edge of a sheet when said sheet manipulator is in said second mode; and a controller adapted to actuate said cylindrical member to rotate 180° after a predetermined time when said sheet manipulator is in said first mode, and adapted to receive a signal from said sensor and actuate said cylindrical member to rotate counter-clockwise and thereby feed inverted substrates back into said predetermined feed path when said sheet manipulator is in said second mode.

* * * * *